US010465895B2

(12) United States Patent
Matsuo

(10) Patent No.: US 10,465,895 B2
(45) Date of Patent: Nov. 5, 2019

(54) LIGHT SOURCE DEVICE

(71) Applicant: NICHIA CORPORATION, Anan-shi, Tokushima (JP)

(72) Inventor: Hidenori Matsuo, Hadano (JP)

(73) Assignee: NICHIA CORPORATION, Anan-shi (JP)

( * ) Notice: Subject to any disclaimer, the term of this patent is extended or adjusted under 35 U.S.C. 154(b) by 185 days.

(21) Appl. No.: 15/280,405

(22) Filed: Sep. 29, 2016

(65) Prior Publication Data

US 2017/0089559 A1 Mar. 30, 2017

(30) Foreign Application Priority Data

Sep. 30, 2015 (JP) ..... 2015-195234

(51) Int. Cl.

| | |
|---|---|
| ***F21V 29/51*** | (2015.01) |
| ***F21V 23/06*** | (2006.01) |
| ***F21V 29/76*** | (2015.01) |
| *F21Y 115/30* | (2016.01) |

(52) U.S. Cl.

CPC ..... *F21V 29/51* (2015.01); *F21V 23/06* (2013.01); *F21V 29/76* (2015.01); *F21Y 2115/30* (2016.08)

(58) Field of Classification Search

CPC ..... F21V 29/51; F21V 29/76; F21V 23/06; F21Y 2115/30; H01S 5/02469; H01S 5/4025; H01S 5/02; H01S 5/02212; H04N 9/3111; H04N 9/3161; H04N 9/3164

See application file for complete search history.

(56) References Cited

U.S. PATENT DOCUMENTS

| | | | | |
|---|---|---|---|---|
| 2007/0091622 | A1* | 4/2007 | Huang | F21V 29/02 362/373 |
| 2007/0147045 | A1 | 6/2007 | Kimura et al. | |
| 2008/0117597 | A1* | 5/2008 | Zhou | H01L 33/648 361/700 |
| 2008/0150126 | A1* | 6/2008 | Zhou | F21K 9/00 257/712 |

(Continued)

FOREIGN PATENT DOCUMENTS

| | | | |
|---|---|---|---|
| JP | 2002090079 | A | 3/2002 |
| JP | 2005217354 | A | 8/2005 |

(Continued)

*Primary Examiner* — Anh T Mai
*Assistant Examiner* — Fatima N Farokhrooz
(74) *Attorney, Agent, or Firm* — Hunton Andrews Kurth LLP

(57) ABSTRACT

A light source device includes a plurality of light sources each comprising a semiconductor laser device, a mounting body to which the plurality of light sources is attached, and at least one heat conducting member. The mounting body has a front surface to be a light emitting side and a rear surface opposite to the front surface. The rear surface has at least one first surface portion. Terminals of at least one of the plurality of light sources protrude from each of the at least one first surface portion. The rear surface has at least one second surface portion which is closer to the front surface than any one of the at least one first surface portion. Each of the at least one heat conducting member is in contact with corresponding one of the at least one second surface portion.

20 Claims, 9 Drawing Sheets

(56) References Cited

U.S. PATENT DOCUMENTS

| | | | | |
|---|---|---|---|---|
| 2008/0315232 | A1* | 12/2008 | Matsuo | H01L 33/46 257/98 |
| 2011/0194578 | A1* | 8/2011 | Hirose | H01S 5/02469 372/36 |
| 2012/0287954 | A1* | 11/2012 | Saruwatari | H01S 5/02469 372/34 |
| 2012/0320589 | A1* | 12/2012 | Wang | F28D 15/0275 362/249.02 |
| 2017/0271843 | A1* | 9/2017 | Batchelder | H01S 5/02469 |

FOREIGN PATENT DOCUMENTS

| | | | |
|---|---|---|---|
| JP | 2006-019557 | A | 1/2006 |
| JP | 2007-281403 | A | 10/2007 |
| JP | 2011-164633 | A | 8/2011 |
| JP | 2011-165760 | A | 8/2011 |
| JP | 2012-256860 | A | 12/2012 |
| JP | 2013062172 | A | 4/2013 |
| JP | 2017033779 | A | 2/2017 |

* cited by examiner

L1>L2>L3

LIGHT SOURCE DEVICE

CROSS-REFERENCE TO RELATED APPLICATIONS

This application claims the benefit of Japanese Patent Application No. 2015-195234 filed on Sep. 30, 2015. The entire disclosure of Japanese Patent Application No. 2015-195234 is incorporated by reference herein.

BACKGROUND

Technical Field

The present invention relates to a light source device, specifically, to a light source device equipped with a semiconductor laser device.

Description of Related Art

JPA 2011-165760 discloses a light source device with a plurality of semiconductor laser devices placed in an array on a support member.

SUMMARY

In the light source device described in JPA 2011-165760, semiconductor laser devices are attached to a top surface of a support member, so that it may be difficult to decrease a thickness of the device. Further, the semiconductor laser devices are in contact with the support member only on their bottom surfaces, which may limit dissipation of heat generated by the semiconductor laser devices.

An objective of embodiments of the present invention is to address these problems and to provide a light source device which can be downsized and high heat radiation property.

A light source device includes a plurality of light sources each comprising a semiconductor laser device, a mounting body to which the plurality of light sources is attached, and at least one heat conducting member. The mounting body has a front surface to be a light emitting side and a rear surface opposite to the front surface. The rear surface has at least one first surface portion. Terminals of at least one of the plurality of light sources protrude from each of the at least one first surface portion. The rear surface has at least one second surface portion which is closer to the front surface than any one of the at least one first surface portion. Each of the at least one heat conducting member is in contact with corresponding one of the at least one second surface portion.

According to the above stated aspect, a light source device may be provided which can be downsized with an enhanced heat radiation property may be provided.

DETAILED DESCRIPTION

Referring to the accompanying drawings, the light source device according to embodiments of the invention will be hereinafter described.

First Embodiment

First, referring to FIGS. 1 and 2, a light source device according to a first embodiment of the invention will be described.

Figure 1A:
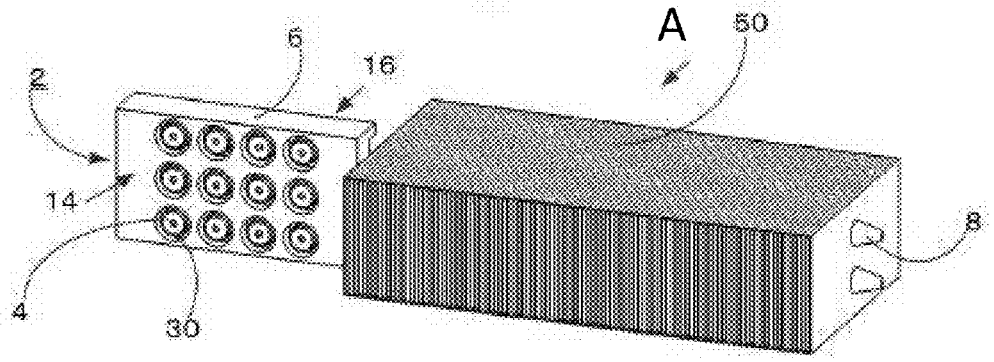
FIGS. 1A to 1C are schematic perspective and plan views of a light source device according to a first embodiment of the invention.

FIG. 1A is a schematic perspective view of a light source device 2 and a heat radiator 50 thermally connected to the light source device 2 via heat pipes 8, showing a mounting body 6 of the light source device 2, seen from a front surface 14 side which is a light emitting side.

Figure 1B:
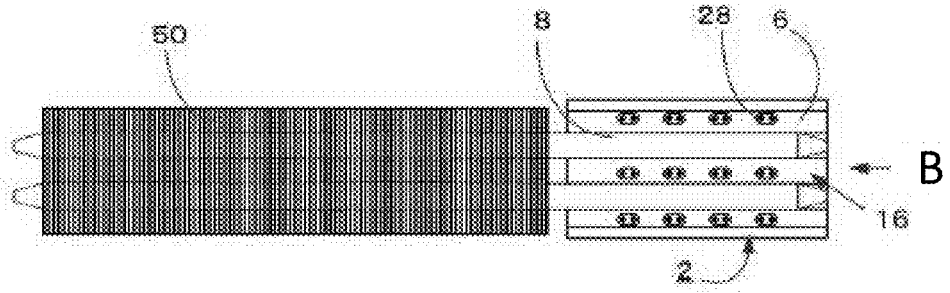

FIG. 1B is a schematic plan view seen in a direction indicated by the arrow A of FIG. 1A, showing the mounting body 6 of the light source device 2, seen from a rear surface 16 side which is opposite to the front surface. In more detail, FIG. 1B shows the construction such that the heat pipes 8 are attached to the mounting body 6 of the light source device 2.

Figure 1C:
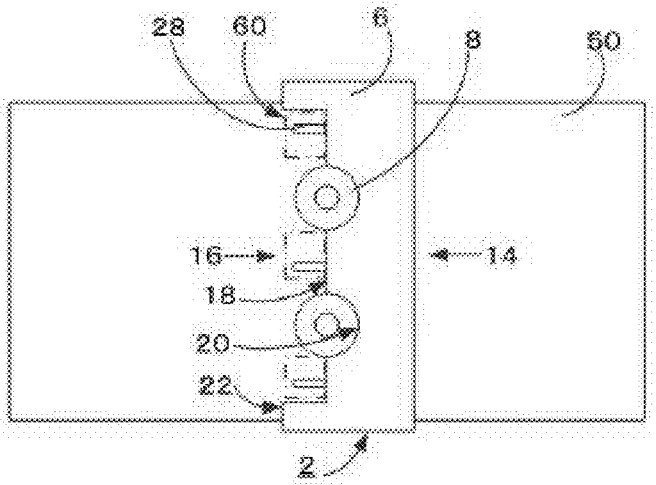

FIG. 1C is a schematic plan view of the light source device 2 seen in a direction indicated by the arrow B of FIG. 1B. In more detail, FIG. 1C is a plan view showing the mounting body 6 seen from the end being opposite to the direction in which the heat pipe 8 extends towards a heat radiator 50.

Figure 2A:
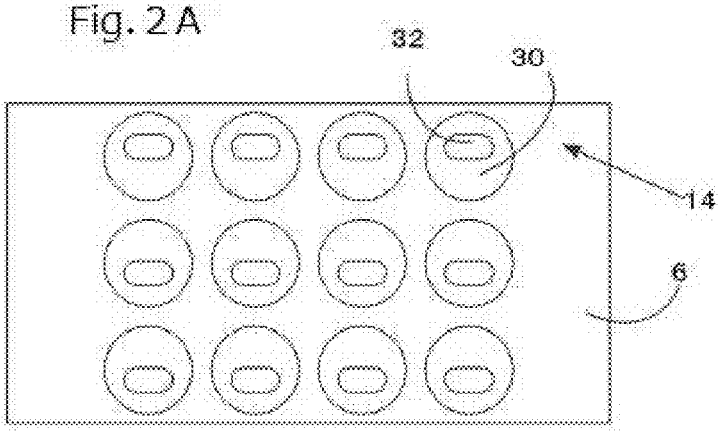
FIGS. 2A to 2C are schematic plan views of a mounting body for the light source device according to a first embodiment of the invention.
Figure 2B:
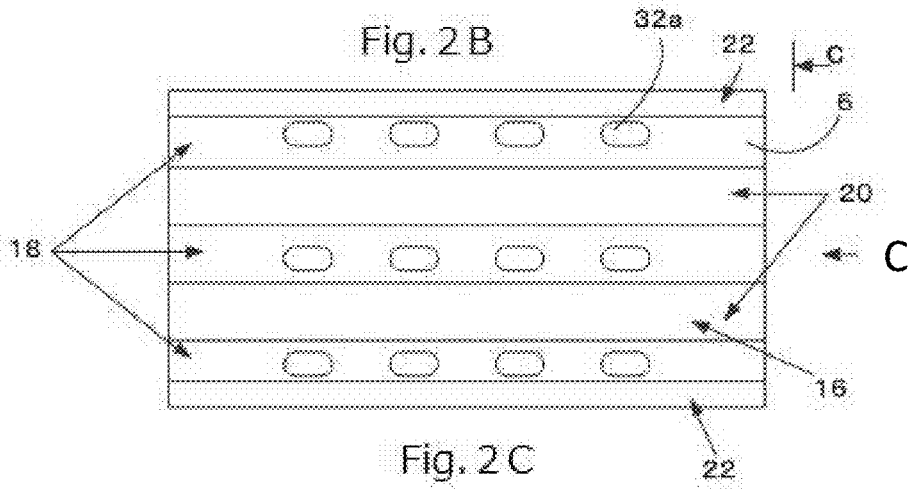
Figure 2C:
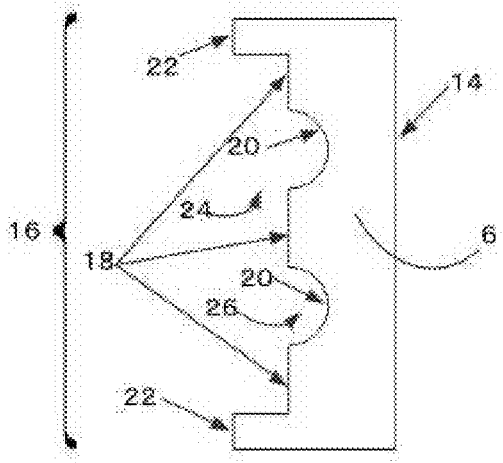

FIGS. 2A to 2C schematically show the mounting body 6 provided in the light source device 2 as shown in FIGS. 1A to 1C.

In more detail, FIG. 2A is a schematic plan view showing the mounting body 6, seen from the front surface 14 side.

FIG. 2B is a schematic plan view showing the mounting body 6, seen from the rear surface 16 side. FIG. 2C is a schematic plan view seen in a direction indicated by the arrow C of FIG. 2B, which means a plan view of the mounting body 6 seen from the same position as FIG. 1C. Thus, FIG. 2C is a drawing depicting only the mounting body 6 from FIG. 1C.

The light source device 2 according to the first embodiment of the invention has light sources 4, the mounting body 6 on which the light sources 4 are mounted, and heat pipes 8 which act as heat conducting members. In this embodiment, there are three rows in which four light sources 4 are lined respectively, and therefore, twelve light sources in total are mounted on the mounting body 6. However, the number of the light sources is not limited thereto, and any number of the light sources may be sufficient.

Also, each row may have two or more light sources.

Further, the mounting body may have one or more rows.

Although a semiconductor laser device (laser diode—LD) is used as the light source 4 in this embodiment, it is not limited thereto. Any other type of light source such as a light emitting diode (LED) may be used as the light source 4.

As shown in FIG. 1A, light source housing portions (recesses for housing the light sources) 30 are provided in the mounting body 6.

Figure 5A:
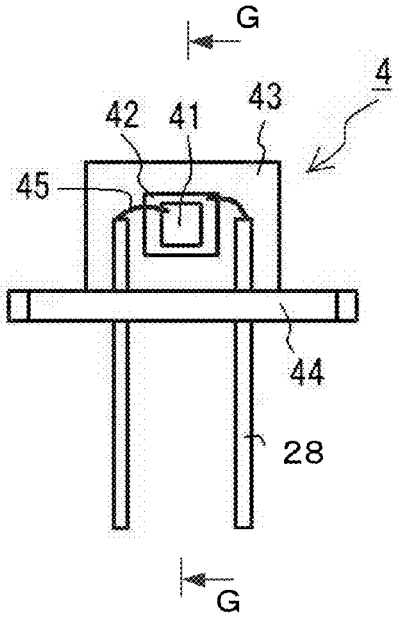
FIGS. 5A to 5B are side and cross-sectional views of an exemplary light source used in the embodiments.
Figure 5B:
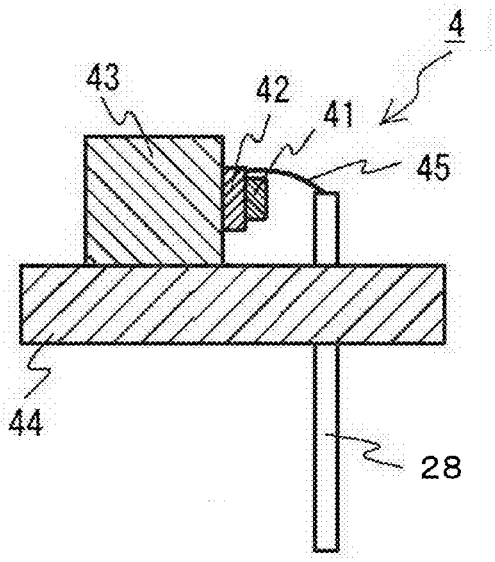

The light sources 4 are housed in the light source housing portions (recesses) 30. Referring to FIGS. 5A and 5B showing details of the light source 4 are shown, side surfaces and bottom surface of a body 44 of the light source 4 are in contact with the inner surfaces of the light source housing portion 30 via fixing material such as solder. Accordingly, since the side surfaces and bottom surface of the body 44 of the light source 4 are in contact with the inner surfaces of the light source housing portion 30, directions of the light emitted from light sources 4 may be adjusted precisely.

Further, although a temperature of the light source 4 is increased in the case of using semiconductor laser device (LD) as the light source 4, an effective radiation of the heat from the light source 4 may be achieved by arrangement of the light sources 4 in the light source housing portions (recesses) 30, as described in detail below.

As shown in FIGS. 1B and 1C, the heat pipes 8 are in contact with the rear surface 16 of the mounting body 6 of the light source device 2. The heat pipes (heat conducting members) 8 are connected to the heat radiator 50.

Accordingly, the heat from the light sources 4 flows into the mounting body 6 which is thermally in contact with the light sources 4 with a plurality of surfaces (side and bottom surfaces) of the light source housing portions (concaves) 30, and further flows into the heat radiator 50 through the heat pipes (heat conducting members) 8 which are thermally in contact with mounting body 6. As described above, heat generated by the light sources 4 is effectively transmitted to the heat radiator 50 through the light source housing portions 30 provided in the mounting body 6, and thereby enhancing the heat radiation property of the light source device 2.

FIG. 1C shows a wiring board 60 which is electrically connected to terminals 28 of the light sources 4 as well as the mounting body 6, the light source 4 (only terminals 28 are shown) and the heat pipes (heat conducting members) 8.

As shown in FIG. 2C, the rear surface 16 of the mounting body 6 has a first surface portion 18 from which the terminals 28 of the light source 4 protrude, and a second surface portion 20 which is closer to the front surface 14 than the first surface portion 18. The heat pipes (heat conducting members) 8 are in contact with the second surface portion 20. The wiring boards 60, which are electrically connected to the terminals 28 of the light sources 4, are placed on the first surface portion 18.

Further, the rear surface 16 of the mounting body 6 has a third surface portion 22 which is further away from the front surface 14 than the first surface portion 18. As described above, the rear surface 16 of the mounting body 6 includes all the surfaces which are visible from the rear surface side. In this embodiment, the rear surface 16 has the second surface portion 20, the first surface portion 18, and the third surface portion 22 in distance order from the front surface 14.

FIG. 2A showing the mounting body 6, seen from the front surface 14 side shows the light source housing portions (cavities) 30 which are spaces for housing the light sources 4 and terminal housing portions (cavities for housing terminals) 32 positioned at the rear surface 16 side compared to the bottom surfaces of the light housing portions (cavities) 30. Each of the terminal housing portions (cavities for housing terminals) 32 is a through-hole extending from the bottom surface of the light housing portion (cavity) 30 to the first surface portion 18 of the mounting body 6 so that the terminals 28 of the light source 28 protrude from the first surface 18 toward the rear surface 16 side.

In this embodiment, the terminals 28 of the light sources 4 are each arranged offset from the center of each of light source 4 in a plan view. Accordingly, the terminal housing portion 32 is also arranged offset from the center of the light housing portion 30. The arrangement of the terminal housing portion 32 will be hereinafter described in detail with reference to FIGS. 8A to 8G.

FIG. 2B showing the mounting body 6, seen from the rear surface 16 side shows openings 32*a* of the terminal housing portions 32 provided at the first surface portion 18, from which the terminals 28 of the light sources 4 protrude.

As shown in FIG. 2C, the second surface portion 20 is curved in this embodiment. In this case, the heat pipe (heat conducting member) 8 may be in significant contact with the mounting body 6 by forming the second surface portion 20 with a curved surface corresponding to an external configuration of the heat pipe (heat conducting member) 8 having a curved surface (rounded or ellipsoidal surface), and thereby enhancing the heat radiation property of the light source device 2.

Specifically, if the second surface portion 20 is curved, the heat pipe (heat conducting member) 8 which has a curved external surface may be in significant contact with the second surface portion 20, and thereby increasing a contact area even in a limited space at the rear surface 16 side.

However, the external surface of the heat pipe (heat conducting member) 8 is not limited to a curved surface. For example, if the external surface of the heat pipe (heat conducting member) 8 is flat (for example, square or rectangular cross section shape), the second surface portion 20 may be flat accordingly. In this case, the heat pipe (heat conducting member) 8 having a flat external surface may be in significant contact with the second surface portion 20. Further, in this case, the second surface portion 20 may be formed easily, and thereby reduce manufacturing costs of the mounting body 6.

In FIG. 2C, a first recess 24 is formed at the rear surface side of the mounting body 6. The first recess 24 is a space defined by the first surface portion (corresponding to the bottom surface) 18 and inner side surfaces which connect the first surface portion 18 and the third surface portion 22.

Second recesses 26 are formed on the bottom surface of the first recess 24. The second recesses 26 are spaces defined by the second surface portion (corresponding to the bottom surface) 20. In this embodiment, two second recesses 26 are provided along the rows in which the light sources 4 are lined (total 3 rows).

In the case where each of the second surface portions 20 are a flat surface, the second recesses 26 are spaces defined by the second surface portions (corresponding to the bottom surface) 20, the side surfaces which connect the second surface portion 20 and the first surface portion 18, with an opening on the top.

As shown in FIG. 1C, the terminal 28 of the light source 4 protrudes through the opening 32*a* which is an opening provided on the first surface portion 18 of the terminal housing portion (cavity) 32 and is positioned in the first recess 24. Since the third surface portion 22 is positioned further away from the front surface 14 than the tip of the terminals 28, the terminals 28 may be protected. Further, the wiring board 60 to which the terminals 28 are electrically connected is placed on the first surface portion 18, and thus, it may be housed within the first recess 24.

As described above, since the wiring boards 60 electrically connected to the terminals 28 are placed on the first surface portion 18, the wiring boards 60 can be arranged in an efficient and space-effective manner in the mounting body 6 in which the heat conductive member is in contact with second surface portion 20.

Further, since the third surface portion 22 is placed at a further away position (rear surface side) from the front surface 14 than the wiring boards 60, the terminal 28 or the wiring boards 60 electrically connected to the terminals 28 may also be protected. The third surface portion 22 may also be used as a mounting surface of the light source device 2. In this case, it can improve a cooling efficiency by making the third surface portion 22 in contact with the cooling member.

The wiring boards are configured by three wiring boards 60 extending along the rows in which four light sources 4 are arranged. The three wiring boards 60 may be electrically isolated from each other so that the light sources connected to one wiring board can be driven independently. In contrast, the three wiring boards 60 may be electrically connected to each other so that light sources connected to the wiring boards may be driven as a whole. In the case that the three wiring boards 60 are electrically connected to each other, the three wiring boards 60 may be electrically connected to form an E shape at the side being opposite to the direction in which the heat pipes (heat conducting members) 8 extend toward the heat radiator 50 (at the right side of the end of the heat pipe 8 in FIG. 1B).

As shown in FIG. 1C, the heat pipes (heat conducting members) 8 are placed between the adjacent wiring boards 60. In this embodiment, the second surface portions 20 are positioned closer to the front surface 14 than the first surface portion 18, and the heat pipes 8 which are heat conducting members are in contact with the second surface portions 20. Accordingly, since the heat pipes (heat conducting members) 8 have larger cross sections and can be arranged in this manner, the cooling efficiency of the light source device 2 may further be enhanced.

Light Source 4

Referring to FIGS. 5A and 5B, an example of a light source 4 of the plurality of light sources 4 used in the present embodiment will be described below. FIG. 5A is a side view of the light source 4, seen from a mounting surface side of a semiconductor element 41, and FIG. 5B is a cross sectional view of the light source 4, taken along line G-G in FIG. 5A. As can be seen from those drawings, in the light source 4, a mounting element 43 is mounted on the top surface of a base 44, and a semiconductor element 41 is mounted on the mounting element 43 via a sub-mount 42. Wires 45 electrically connected to the sub-mount 42 are electrically connected to the top end of the terminal 28. The terminal 28 extends downwardly from the bottom surface of the base 44. Side surfaces of the body 44 are in contact with the inner side surface of the light housing portion (cavity) 30 of the mounting body 6 via solder or the like, and the bottom surface of the body 44 is in contact with the bottom surface of the light housing portion (cavity) 30 of the mounting body 6 via solder or the like. A semiconductor laser element (LD) is exemplified as the light source 4.

Construction of the emitting element 41 is not specifically limited, and emitting light having the same wavelength or different wavelength (i.e., emitting different colors such as red, green, blue or the like) may be used.

Mounting Body 6

The mounting body 6 is a member to support the light sources 4. The mounting body 6 is preferably formed by aluminum or aluminum alloy, and also copper or copper alloy. It can be also formed by stainless steel (Austenitic, Ferritic, Martensitic), steel material (carbon steel for machine structural use, general structural rolled steel), Super Invar, Kovar, ceramic materials such as aluminum nitride or the like.

Heat Pipe 8

A heat pipe with a circular column shape or with a rectangular column shape can be used as the heat pipe 8 which acts as the heat conducting member. The heat pipe may be formed by a copper tube and may be plated. Water is contained and sealed in the heat pipe for transferring heat. Inside of the heat pipe may be vacuumed to prevent deterioration.

The heat pipe (heat conducting member) 8 and the mounting body 6 may be connected by soldering or by calking. As stated above, if the second surface portion 20 is curved, the second surface portion 20 is in contact better with the heat pipe (heat conducting member) 8. If the second surface portion 20 is flat, the second surface portion (corresponding to the bottom surface) 20 and the side surfaces which connect the second surface portion 20 and the first surface portion 18 are in contact with the heat pipe (heat conducting member) 8.

Heat Radiator 50

The heat radiator 50 in this embodiment is a heat sink.

The heat sink is preferably a stack-fin type radiator in which a number of fins are stacked and the pipe shape can be fixed easily. The fins may be fixed to the heat radiation tubes by soldering. However, the calking is preferably used to prevent any problem which may be caused in the subsequent thermal treatment process. The material for the fin may be stainless steel, copper, or aluminum alloy. In particular, from the view point of the heat radiation and cost, aluminum sheets of 1000 or 6000 series are preferably used.

As described above, in the embodiment, since the heat pipe (heat conducting member) 8 is in contact with the second surface portion 20 which is closer to the front surface 14 than the first surface portion 18, the heat pipe (heat conducting member s) 8 having larger cross sectional shape can be placed on the mounting body 6 which can be downsized, and thereby further improve the cooling efficiency. Accordingly, a compact light source device with an enhanced heat radiation property can be provided in the embodiment.

As can be seen from FIG. 1C, the wiring boards 60 and the heat pipe (heat conducting member) 8 are accommodated space-efficiently with a minimum space loss within a space having the first recess 24 and second recesses 26 defined by the first surface portions 18, the second surface portions 20, and the third surface portion 22. Specifically, since the third surface portion 22 forms the lowermost surface portion of the mounting body 6 and is used for a mounting surface on a substrate, it can protect the terminals 28 of the light sources 4 and the wiring boards 60 to which the terminals 28 are connected from being damaged.

Since the wiring board 60 or the like does not protrude beyond the third surface portion 22, the third surface portion 22 may be in contact with the heat conducting element or other cooling elements, and thereby further improve the cooling efficiency.

Second Embodiment

Figure 3A:
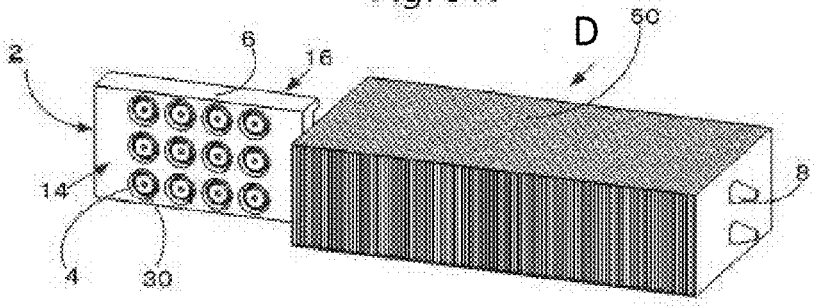
FIGS. 3A to 3C are schematic perspective and plan views of a light source device according to a second embodiment of the invention.
Figure 3B:
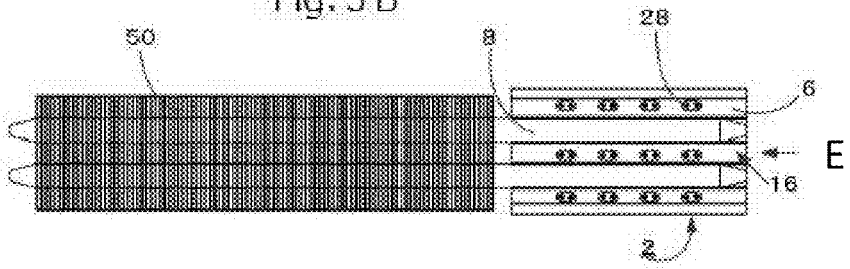
Figure 3C:
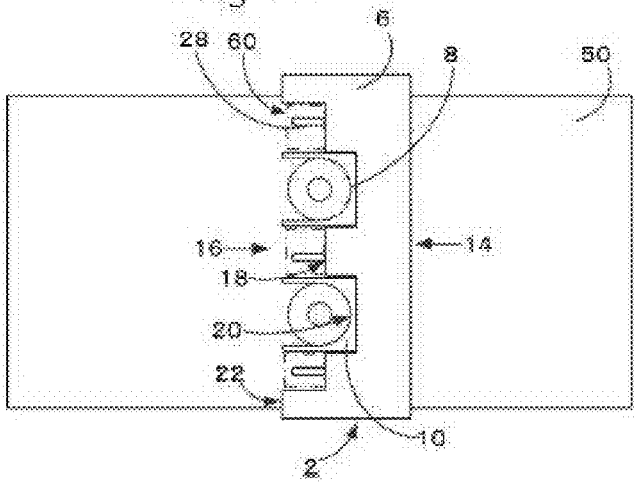

Next, referring to FIGS. 3A to 3C and 4A to 4C, a light source device according to a second embodiment of the invention will be described. FIGS. 3A to 3C schematically show the light source device 2 of the second embodiment. In particular, FIG. 3A is a schematic perspective view of the light source device 2 of the second embodiment and the heat radiator 50 thermally connected to the mounting body 6 via heat pipes 8, showing the mounting body 6 of the light source device 2, seen from a front surface 14 side.

FIG. 3B is a schematic plan view seen in a direction indicated by an arrow D in FIG. 3A, showing the mounting body 6 of the light source device 2, seen from a rear surface 16 side.

FIG. 3B shows that the heat pipe 8 is attached to the mounting body 6 of the light source device 2. FIG. 3C is a schematic plan view of the light source device 2, seen in a direction indicated by an arrow E in FIG. 3B.

FIG. 3C is a plan view, seen from the end being opposite to the direction that the heat pipes 8 extends toward the heat radiator 50.

Figure 4A:
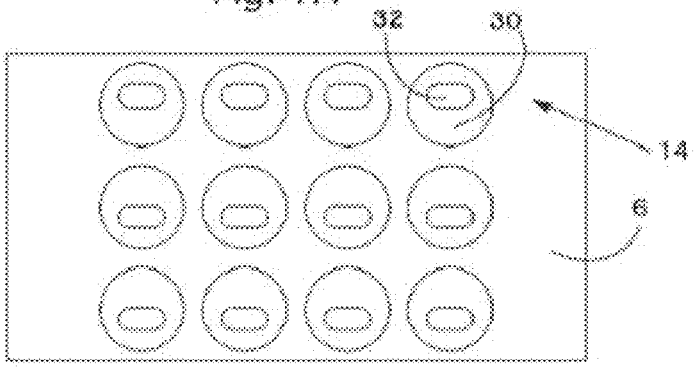
FIGS. 4A to 4C are schematic plan views of a mounting body of the light source device according to the second embodiment of the invention.
Figure 4B:
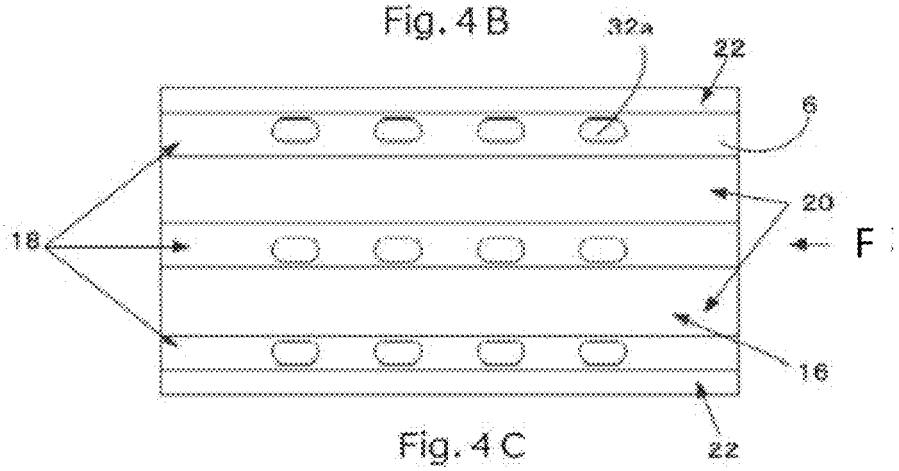
Figure 4C:
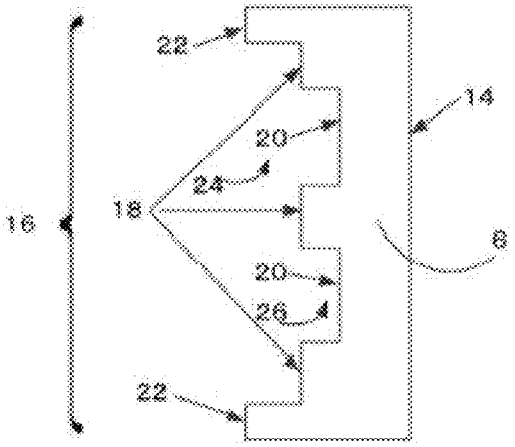

FIGS. 4A to 4C schematically show the mounting body 6 provided in the light source device 2 shown in FIGS. 3A to 3C. In particular, FIG. 4A is a schematic plan view of the mounting body 6 of the light source device 2, showing the mounting body 6, seen from the front surface 14 side. FIG. 4B is a schematic plan view showing the mounting body 6, seen from the rear surface 16 side. FIG. 4C is a schematic plan view, seen in a direction indicated by an arrow F of FIG. 4B, which means a plan view of the mounting body 6 seen from the same position as FIG. 3C.

In the second embodiment, the light source device 2 includes highly heat conducting blocks 10 as heat conducting members, and the highly heat conducting blocks (heat conducting members) 10 are in contact with second surface portions 20. A surface of each of the highly heat conducting blocks (heat conducting members) 10 opposite to a surface in contact with the second surface portion 20 is in contact with each of the heat pipes 8.

Except for the above-described highly heat conducting blocks (heat conducting members) 10, the second embodiment is similar to the first embodiment. Therefore, discussion will hereinafter be made primarily to the highly heat conducting blocks (heat conducting members) 10, and the other description will be omitted.

In this embodiment, as shown in FIG. 4C, the second surface portion 20 of the mounting body 6 is a flat surface, and the first surface portion 18 and the second surface portion 20 are connected by opposing side surfaces extending vertically from the opposite ends of the flat second surface portion 20, so that the second recesses 26 each has a rectangular cross section. As shown in FIG. 3C, the highly heat conducting blocks 10 are fitted with the second surface portions 20 and the associated side surfaces, serving as heat conducting members. A surface of each of the highly heat conducting blocks 10 which is opposite to the surface being in contact with the second surface portion 20 is curved, and each of the heat pipe with a circular column shape is fitted with the curved surface. Accordingly, in this embodiment, the mounting body 6 and the heat pipes 8 are thermally connected via the highly heat conducting blocks (heat conducting members) 10.

Since the highly heat conducting blocks (heat conducting members) 10 are in contact with the mounting body 6 and the heat pipes 8, it may receive the heat from the light source 4 with thermal surface contact, and thereby transfer heat to the heat pipes 8 efficiently. Accordingly a heat radiation property with high efficiency may be provided by the heat radiator 50 via the heat pipes 8.

Highly Heat Conducting Block (Heat Conducting Member) 10

Preferably, the highly heat conducting blocks (heat conducting members) 10 are each formed from a material having a higher heat conductivity than that of the mounting body 6, such as copper alloy or the like. Further, preferably the highly heat conducting blocks (heat conducting members) 10 each has a thin profile so that heat received by the block 10 is instantly transferred to the heat pipe.

Bonding between the high conduction blocks (heat conducting members) 10 and the mounting body 6 and bonding between the highly conducting blocks (heat conducting members) 10 and the heat pipes 8 may be performed by soldering or calking.

According to this embodiment, the highly heat conducting blocks (heat conducting members) 10 each has an approximately U-shape profile with a rectangular external shape and a circular inner shape so as to fit with the second recesses 26 each having a rectangular sectional shape and the heat pipes 8 each having a circular column shape. Specifically, since the highly heat conducting blocks (heat conducting members) 10 each has a pair of opposing side walls which extend to a height substantially similar to that of the third surface portions 22, the heat radiation property can be enhanced by contacting not only the third surface portions 22 but also the cooling member.

The highly heat conducting blocks (heat conducting members) 10 described above and indicated in FIG. 3C may each have any appropriate shape, and any external and internal configuration may be applied according to the cross-sectional shape of each of the second recesses 26 and the external shape of each of the heat pipes 8.

As described above, similar to the first embodiment, a light source device which can be downsized with enhanced heat radiation property may be provided by using the highly heat conducting blocks (heat conducting members) 10 with high heat conductivity being in contact with the mounting body 6 and the heat pipe 8 with a thermal surface contact.

Third Embodiment

Figure 6A:
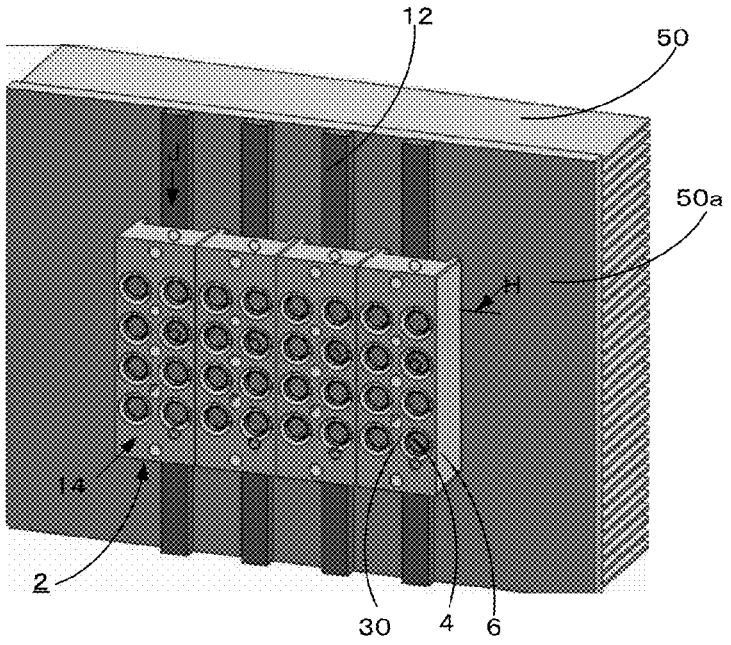
FIGS. 6A to 6C are schematic perspective views of a light source device according to a third embodiment of the invention.
Figure 6B:
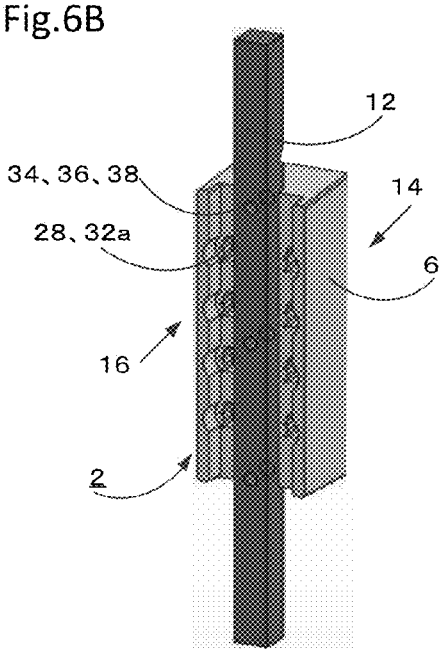
Figure 6C:
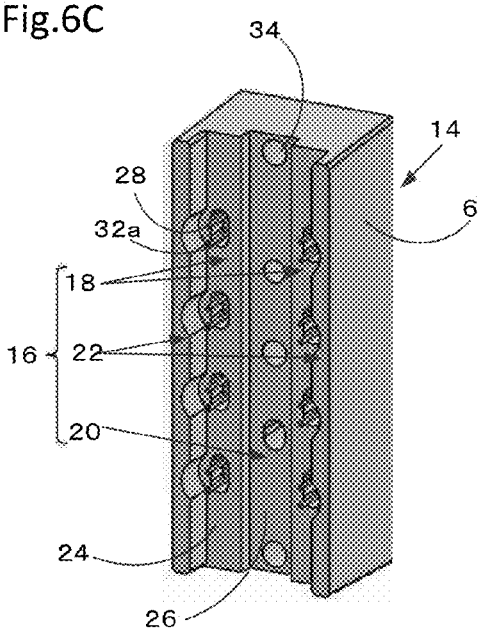

Next, referring to FIGS. 6A to 6C, a light source device according to a third embodiment of the invention will be described. FIGS. 6A to 6C schematically show a light source device 2 according to a third embodiment of the invention. In particular, FIG. 6A is a schematic perspective view of a light source device 2 and a radiator 50 connected to the light source devices 2 via highly heat conducting elements 12, showing a mounting body 6 of the light source device 2, seen from a front surface 14 side. FIG. 6B is a schematic perspective view of the mounting body 6 of the light source device 2, seen from a rear surface 16 side, in a direction indicated by an arrow H in FIG. 6A, showing that the highly heat conducting element 12 is mounted on the mounting body 6 of the light source device 2. FIG. 6C is a schematic perspective view of the mounting body 6, only showing the mounting body 6 from a rear surface 16 side by removing the highly heat conducting element 12 from FIG. 6B.

FIG. 6A shows four mounting bodies 6 mounted on the heat radiator 50 via the highly heat conducting elements 12. FIGS. 6B and 6C show one of the mounting bodies 6, seen from the rear surface 16 side.

Although in the first embodiment, the heat pipes (heat conducting members) 8 are in contact with the second surface portion 20 of the mounting body 6 and the heat pipes (heat conducting members) 8 are in contact with the heat radiator 50, in this embodiment, the highly heat conducting element 12 acting as the heat conducting member is in contact with the second surface portion 20 of the mounting body 6, and a longitudinal length of the highly heat conducting element (heat conducting member) 12 is designed to be longer than that of the mounting body 6. Further, a surface of the highly heat conducting element (heat conducting member) 12 opposite to the surface in contact with the second surface portion 20 is in contact with the heat radiator 50.

In this embodiment, not only the highly heat conducting element (heat conducting member) 12 but also the heat radiator 50 constitutes a part of the light source device 2. However, this embodiment is not limited thereto, and it may include a modification in which the highly heat conducting element (heat conducting member) 12 is included, but the heat radiator 50 is not included in the light source device 2.

Except the above stated points, the third embodiment is similar to the first embodiment. Therefore, discussion will hereinafter be made primarily to the highly heat conducting element (heat conducting member) 12, and the other description will be omitted.

In this embodiment, as shown in 6C, the second surface portion 20 of the mounting body 6 is a flat surface, and side surfaces which connect the first surface portion 18 and the second surface portion 20 are vertical flat surfaces, so that the second recess 26 has a rectangular cross section. As shown in FIG. 6B, the highly heat conducting element 12 fits with the second surface portion 20 and the side surfaces as the heat conducting member. A surface of the highly heat conducting element (heat conducting member) 12 being opposite to the surface being in contact with the second surface portion 20 is flat, and the highly heat conducting element (heat conducting member) 12 is in contact with the heat radiator 50 on this surface.

Accordingly, as shown in FIG. 6A, a plurality of light sources 4 (eight in this embodiment) are housed in the light source housing portions 30 of the mounting body 6. Then, the plurality of mounting bodies (four in this embodiment) 6 are mounted on a mounting surface 50*a* of the heat radiator 50 via the highly heat conducting elements (heat conducting member) 12. In this embodiment, a length of the heat conduction element (heat conducting member) 12 along the rows of light sources 4 is longer than that of the mounting body 6 so that the heat conduction element (heat conducting member) 12 has a length to reach the edges of the mounting surface 50*a* of the heat radiator 50.

In this embodiment, in order to achieve the construction such that the mounting bodies 6 are mounted on the mounting surface 50*a* of the heat radiator 50 via the highly heat conducting elements (heat conducting member) 12, the mounting bodies 6 and the heat conduction elements (heat conducting members) 12 are connected together, and then the mounting bodies 6 and the connected heat conduction elements (heat conducting members) 12 are connected to the mounting surface 50*a* of the heat radiator 50.

As shown in FIG. 6C, threaded holes 34 are provided on the rear surface 16 side of the mounting body 6. As shown in FIG. 6B, the mounting body 6 and the heat conduction element (heat conducting member) 12 may be fixed by inserting threading fasteners 38 through holes 36 provided in the heat conduction element (heat conducting member) 12 and then screwed to the threaded holes 34 of the mounting body 6. Since the highly heat conducting element (heat conducting member) 12 is designed to be longer than the mounting body 6, the heat conduction element (heat conducting member) 12 may be fixed to the mounting surface 50*a* of the radiator 50, for example, by providing connection holes for the highly heat conducting element (heat conducting member) 12 at the portion positioned outside the mounting body 6.

However, the embodiment is not limited thereto, and the mounting body 6 may be fixed to the mounting surface 50*a* of the heat radiator 50 by inserting threading fasteners through holes provided in the mounting body 6 and threading them to the mounting surface 50*a*. In this case, the highly heat conducting element (heat conducting member) 12 is held between the associated mounting body 6 and the heat radiator 50 by using the fastening force between the associated mounting body 6 and the heat radiator 50. Further, the highly heat conducting element (heat conducting member) 12 may be fixed to the mounting body 6 or the heat radiator 50 independently. The fastening is not limited to one using fasteners, and it may be done by soldering or by calking.

Heat Conduction Element (Heat Conducting Member) 12

Similar to the highly heat conducting block (heat conducting member) 10, the highly heat conducting element (heat conducting member) 12 may preferably be formed by material having a higher heat conductivity than the mounting body 6, such as copper alloy or the like. Further, thickness of the highly heat conducting element (heat conducting member) 12 is preferably as thin as possible so that heat radiation effect is enhanced by instant heat transfer from the mounting body 6 to the highly heat conducting element (heat conducting member) 12.

Although the surfaces of the highly heat conducting element (heat conducting member) 12 both in contact with the mounting body 6 and in contact with the heat radiator 50 are flat, they may be curved.

Figure 7A:
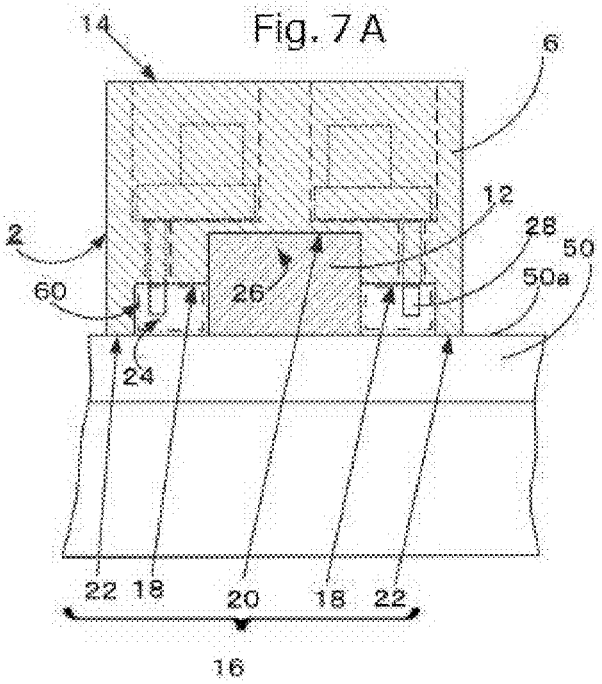
FIGS. 7A to 7B are schematic side views of a light source device according to a third embodiment of the invention.
Figure 7B:
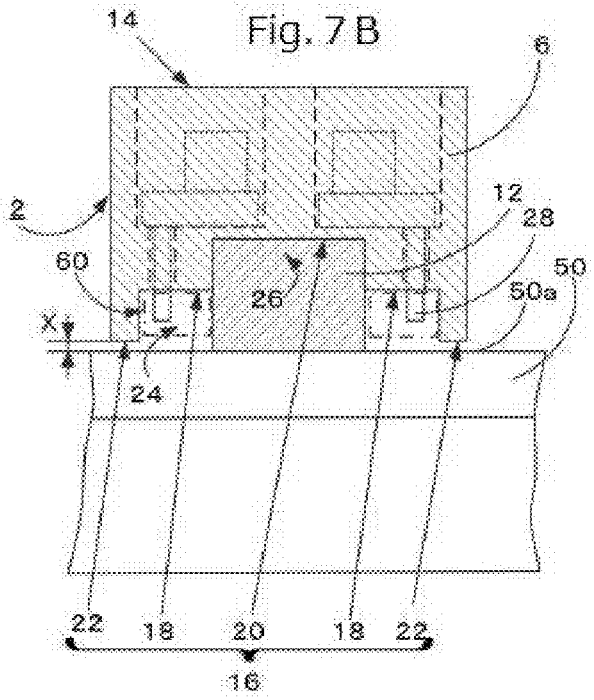

Next, referring to FIGS. 7A to 7B, details will be described relating to the side sectional configuration of the mounting body 6 and the highly heat conducting element (heat conducting member) 12. Both FIGS. 7A and 7B are plan views, seen in a direction indicated by an arrow J in FIG. 6A. In FIG. 7A, the third surface portion 22 is in contact with the mounting surface 50*a* of the heat radiator 50. In contrast, in FIG. 7B, the third surface portion 22 is spaced from the mounting surface 50*a* of the heat radiator 50 by a distance X. Other configurations are similar between in FIG. 7A and in FIG. 7B.

In the present embodiment, in the mounting body 6, a plurality of light sources 4 are arranged in a first row (e.g., row located in left side in FIGS. 7A and 7B) and a second row (e.g., row located in right side in FIGS. 7A and 7B) that are adjacent to each other and parallel to each other, and a first wiring board 60 (e.g., wiring board located in left side in FIGS. 7A and 7B) is electrically connected to terminals 28 of the light sources 4 arranged in the first low, and s second wiring board 60 (e.g., wiring board located in right side in FIGS. 7A and 7B) is electrically connected to terminals 28 of the light sources 4 arranged in the second row. Further, the highly heat-conducting element (heat conducting member) 12 is provided between the first and second wiring boards 60.

The first and second wiring boards 60 may be portions of one wiring board or may be separate wiring boards electrically independent of each other.

As can be seen from FIGS. 7A and 7B, since the highly heat conducting element (heat conducting member) 12 is positioned between the first and second wiring boards 60, a space-effective arrangement with a minimum space loss may be achieved.

As shown in FIGS. 7A and 7B, the terminal 28 of the light source 4 is arranged offset from the center of the associated light source 4, and light sources 4 are oriented to obtain a maximum distance between the terminals 28 of the light sources 4 in the first and second rows. Thus, the terminals 28 of the light sources 4 are placed in opposite outward directions from respective centers of the associated light sources 4 in the width direction (direction being perpendicular to the row of the light source 4) of the mounting body 6.

As stated above, since the light sources 4 are arranged so that the distance between the terminals 28 of the light sources 4 in the first and second rows are made maximum, it is possible to enlarge the distance between the first and second wiring boards 60 to which the terminals 28 in the first and second rows are connected. Accordingly, it is possible to enlarge the cross section of the highly heat conducting element (heat conducting member) 12, which results in enhancing a heat radiation efficiency by the highly heat conducting element (heat conducting member) 12.

As shown in FIG. 7A, if the third surface portion 22 of the mounting body 6 is in contact with the mounting surface 50*a* of the heat radiator 50, heat is transferred to the heat radiator 50 through the highly heat conducting elements (heat conducting member) 12, and in addition to it, directly from the mounting body 6 to the heat radiator 50.

Therefore, a cooling efficiency of the light source device is expected to be enhanced.

As shown in FIG. 7B, if the third surface portion 22 is spaced away from the mounting surface 50*a* of the heat radiator 50, it may prevent an excessive force from being applied to the fasteners or the like due to heat expansion of the mounting body 6. The spaced distance X is preferably optimized according to possible heat distribution or material (coefficient of thermal expansion or the like) of the mounting body 6 or the highly heat conducting element (heat conducting member) 12.

Arrangement of Light Source Housing Portions in Mounting Body

Next, referring to FIGS. 8A to 8G, arrangements of the light source housing portions 30 in the mounting body 6 will be described. FIGS. 8A to 8G are schematic plan views showing various arrangements of the light source housing portions 30 in the mounting body 6.

FIGS. 8A to 8G show the case having one to five rows in which four light sources 4 are lined. In this embodiment, the light sources 4 are positioned within the housing portion 30 with its terminals 28 arranged offset from the center of the light source 4. Similar to the case shown in FIGS. 7A to 7B, the light sources 4 are arranged so as to maximize the distance between the terminals of the light sources 4 in the adjacent rows.

Figure 8A:
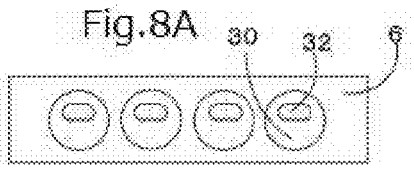
FIGS. 8A to 8G are schematic plan views showing examples of an arrangement of the light source housing portions in the mounting body.
Figure 8B:
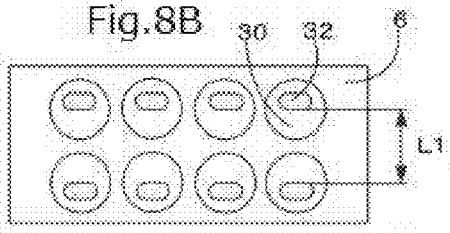

FIG. 8A shows an arrangement which includes a single row of light sources 4. In this arrangement, the terminals 28 of the light sources 4 are positioned in a line. FIG. 8B shows another arrangement which includes two rows of light sources 4. In this arrangement, similar to the arrangement described with reference to FIGS. 7A and 7B, the terminals 28 in one row and another row are placed in opposite outward directions from respective centers of the associated light sources 4 to obtain a maximum distance L1 between the terminals 28 of the light sources 4 in one row and another row.

Figure 8C:
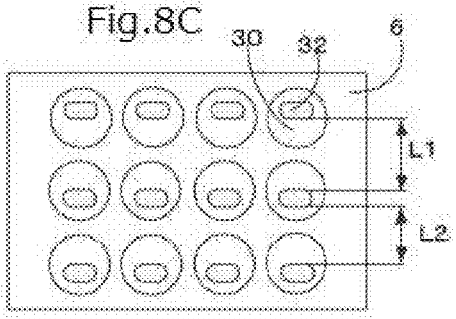

FIG. 8C shows another arrangement which includes three rows of light sources 4. In this arrangement, the light sources 4 in the upper 2 rows in the drawing which mean the first and second rows are positioned to obtain a maximum distance L1 between the terminals 28 in the adjacent first and second rows, similar to the arrangement of FIG. 8B. In contrast, the light sources in the lower 2 lows in the drawing which mean the second and third rows are positioned so that the terminals 28 of the light sources 4 are positioned in the lower position from the center of the light sources 4. Thus, since the terminals 28 of the two rows are placed in the same directions from respective centers of the associated light sources 4, an intermediate distance L2 between the terminals 28 of the light sources 4 in the second and third rows is obtained.

Figure 8D:
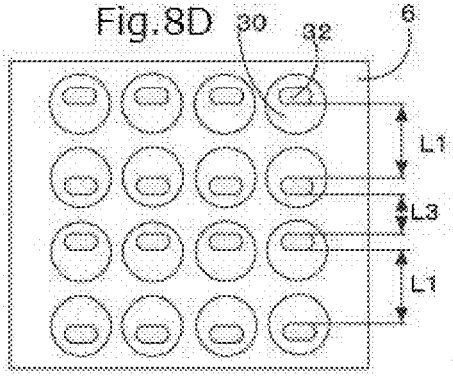

FIG. 8D shows another arrangement which includes four rows of light sources 4. In this arrangement, the terminals in the upper two rows in the drawing which mean the first and second rows, and the terminals in the lower two rows in the drawing which mean the third and fourth rows are positioned to obtain a maximum distance L1 between the terminals 28 in the adjacent rows, similar to the arrangement of FIG. 8B. In contrast, the terminals in the middle two rows in the drawing which mean the second and third rows are positioned inside (closer position), which results in obtaining a minimum distance L3 between the terminals 28 in the second and third rows.

Figure 8E:
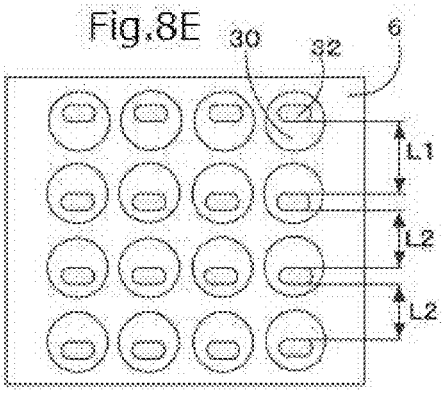

FIG. 8E shows another arrangement which includes four rows of light sources 4. In this arrangement, the light sources 4 in the upper two rows in the drawing which mean first and second rows are positioned to obtain a maximum distance L1 between the terminals 28 in the adjacent first and second rows, similar to the arrangement of FIG. 8B. In contrast, the light sources 4 in the rows lower than the above which mean the second and third rows, and the third and fourth rows are positioned so as to obtain an intermediate distance L2 between the adjacent second and third rows and between the adjacent third and fourth rows.

As described above, as shown in FIG. 8D, if the number of pairs of row(s) obtaining the maximum distance L1 is increased, pair(s) of rows obtaining the minimum distance L3 is(are) generated. In contrast, as shown in FIG. 8E, if the number of pair(s) of rows obtaining the maximum distance L1 is restrained, it may prevent generation of the minimum distance L3.

Figure 8F:
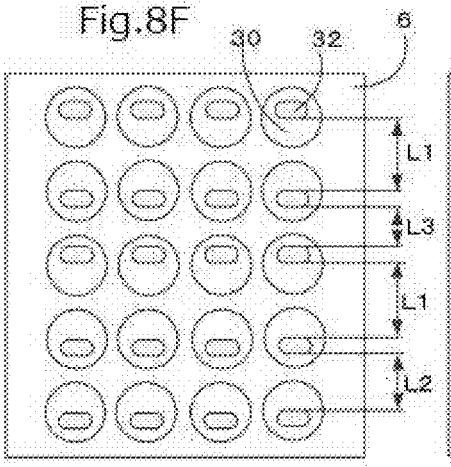
Figure 8G:
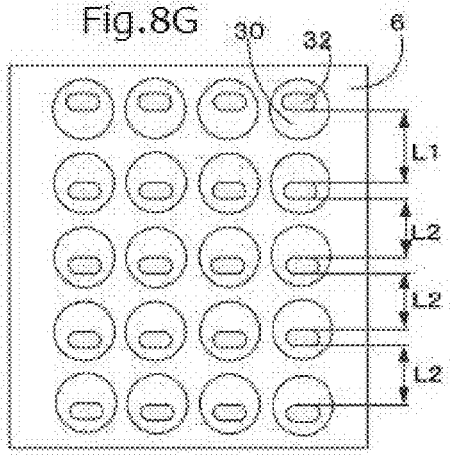

FIG. 8F shows another arrangement which includes five rows of light sources 4. In this arrangement, the light sources 4 are arranged so as to increase the number of pairs of row(s) obtaining a maximum distance L1, and therefore, pair(s) of rows obtaining a minimum distance L3 is(are) also generated. In contrast, in FIG. 8G, the light sources 4 are arranged so as to restrain the number of pair(s) of rows obtaining a maximum distance L1, and therefore, generation of a minimum distance L3 is prevented.

In any event, preferably the optimum arrangement may be selected according to heat generation, required cooling capacity, sizes of the circuit mounting bodies 6 or the like.

Fourth Embodiment

Figure 9A:
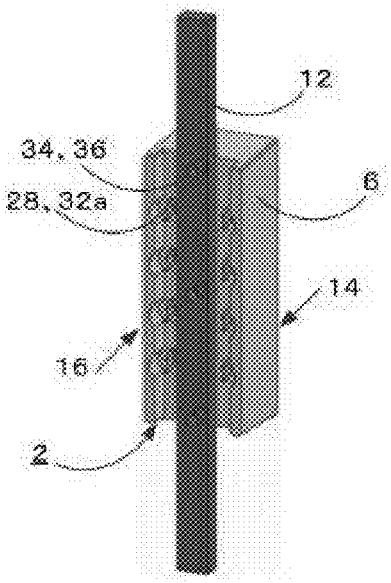
FIGS. 9A to 9B are schematic perspective views of a light source device according to a fourth embodiment of the invention.
Figure 9B:
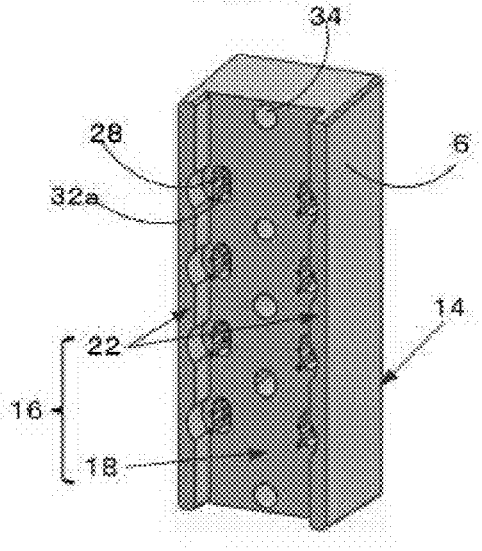

Next, referring to FIGS. 9A and 9B, a light source device according to a fourth embodiment of the invention will be described. FIGS. 9A and 9B schematically show the light source device 2 according to the fourth embodiment. FIG. 9A is a schematic perspective view of a mounting body 6, seen from a rear surface 16 side, showing a highly heat conducting element (heat conducting member) 12 attached to a mounting body 6, and FIG. 9B is a schematic perspective view of the mounting body 6 from which the highly heat conducting element is removed from FIG. 9A, showing only the mounting body 6 from the rear surface 16 side.

As can be seen by comparing the third and fourth embodiments, as shown in FIG. 9B, the fourth embodiment differs from the third embodiment in that the rear surface 16 of the mounting body 6 of this embodiment has a first surface portion 18 from which the terminals 28 of the light sources 4 protrude and a third surface portion 22 further away from the front surface 14 than the first surface portion 18, but does not have a second surface portion closer to the front surface 14 than the first surface portion 18. The fourth embodiment is similar to the third embodiment in the other points.

Although a space to place the highly heat conducting element (heat conducting member) 12 in the fourth embodiment becomes smaller than that in the third embodiment, it will be applicable according to required cooling capacity, or required size reduction. The fourth embodiment may reduce a manufacturing cost due to its structural simplicity.

Example

An example of the light source device 2 will be described.

The light source device 2 is a light source used for a projector, according to the first embodiment.

The light source device includes a mounting body formed by plated aluminum alloy, semiconductor laser devices (LD) as light sources, heat pipes attached to the mounting body, and a heat radiation device (stack-fin radiator) connected to the heat pipe.

The mounting body is an approximately plate-shape member having a thickness of 12.4 mm, and has 12 holes configured by pairs of openings (light source housing portions) each having a diameter of 9.05 mm and a depth of 4.9 mm, and elliptical cross-section through-holes (terminal housing portions) through which terminals pass, formed in the bottom of the opening. The holes are arranged in three rows by four columns with a row and column pitch of 11 mm. The rear surface of the mounting body has semicircular cross-sectional recesses (second recesses) in which the heat pipes are seated and thin film portion (first recess) on which the wiring boards are mounted. The thin film portion (first recess) are shaped and sized to house the lead terminals of the light sources and the wiring boards.

The light sources are each configured such that a semiconductor laser element is mounted on a stem and the cap for holding a glass window is fixed. The stem is formed by gold plated copper-alloy-based material, and has an element mounting block, two lead terminals, and a disk shaped base (base body) having a diameter of 9 mm and a thickness of 1.5 mm. A nitride-based semiconductor laser element is attached to the stem element mounting section, via an aluminum nitride mounting body with gold-tin eutectic soldering on its top and bottom surfaces. The cap is a cylindrical piece made of stainless steel, having a diameter of 6.85 mm, and its bottom ring part is welded to the top of the stem base. The glass window is attached to the top of the cap. At the side of the base of stem (base body), a triangular dent (notch), when seen in the top, is built for the entire thickness.

The above stated base of the stem (base body) is housed in the opening of the mounting body (light source housing portion). A rear surface and side surfaces of the base of the stem (base body) are attached to the corresponding inner walls of the opening by bonding material. The bonding material is tin-silver-copper-based solder.

The diameter of the opening (light source housing portion) ranges between 9.04 mm and 9.06 mm, and the base of the stem (base body) has a diameter of 9 mm. Thus, the thickness of the solder therebetween can be adjusted in tens of microns order accuracy. Therefore, the light sources are mounted at high precision within the light source device and the heat radiation property may be improved because of the low thermal resistance of the thin solder layer.

The heat pipe is in a cylindrical shape, having a diameter of 6 mm, and it is soldered to the cavity with 3 mm in radius, in the support member. Heat is instantly transferred from the base of the stem (base body) of the semiconductor laser device to the heat pipe because it is attached to the cavity of the support member.

The heat radiator is fixed on the heat pipe by calking and is a metal plate made of aluminum having a thickness of 0.2 mm. The heat radiator is cooled by a fan (not shown), which results in a high density arrangement within a limited space.

While the present invention has been described according to the embodiments with a certain degrees of details, contents of disclosure of the embodiments shall be varied in details of the configuration, and the combination of elements and the change of order in the embodiment can be realized without deviating from the scope of the claims and concepts of the present invention.

The light source device of the invention may be used for various devices such as a light source for a projector, a liquid crystal back light, an illumination, various indicators, automotive, displays, traffic signals or the like.

DESCRIPTION OF REFERENCE NUMERALS

2 light source device
4 light source
6 mounting body
8 heat pipe (heat conducting member)
10 highly heat conducting block (heat conducting member)
12 highly heat conducting element (heat conducting member)
14 front surface
16 rear surface
18 first surface portion
20 second surface portion
22 third surface portion
24 first recess
26 second recess
28 terminal
30 light source housing portion (recess for housing light source)
32 terminal housing portion (recess for housing terminal)
**32*a*** opening
34 threaded hole
36 hole
38 fastener
41 semiconductor light emitting element
42 sub-mount
43 mounting element
44 body
45 wire
50 heat radiator
**50*a*** mounting surface
60 wiring board

What is claimed is:

1. A light source device, comprising:

a plurality of light sources each comprising a semiconductor laser device;

a mounting body to which the plurality of light sources is attached; and at least one heat conducting member, wherein the mounting body has a front surface to be a light emitting side and a rear surface opposite to the front surface, the rear surface has a first surface portion, terminals of at least one of the plurality of light sources protrude from the first surface portion, the rear surface has a second surface portion which is closer to the front surface than the first surface portion, each of the at least one heat conducting member is in contact with the second surface portion, the mounting body has a plurality of rows of housing portions, wherein each of the housing portion houses one of the plurality of light sources and has a terminal housing portion through which terminals of the one of the plurality of light sources protrude, and at least in two adjacent rows of housing portions, the terminal housing portions are positioned offset from centers of the corresponding housing portions.

2. The light source device according to claim 1, wherein the rear surface of the mounting body has a plurality of third surface portions that are further away from the front surface than the first surface portion.

3. The light source device according to claim 1, wherein the second surface portion is curved.

4. The light source device according to claim 1, wherein the second surface portion is flat.

5. The light source device according to claim 1, wherein each of the at least one heat conducting member is a heat pipe, and the heat pipe is in contact with the second surface portion.

6. The light source device according to claim 1, further comprising at least one heat pipe;

wherein a surface of each of the at least one heat conducting members that is opposite to a surface in contact with the second surface portion is in contact with each of the heat pipes.

7. The light source device according to claim 1, further comprising a heat radiator, wherein each of the at least one heat conducting member is longer than the mounting body in one direction, and a surface of each of the at least one heat conducting member opposite to a surface which is in contact with the second surface portion is in contact with the heat radiator.

8. The light source device according to claim 1, wherein the front surface of the mounting body has a recess housing the light source.

9. The light source device according to claim 1, wherein a wiring board electrically connected to at least one of the terminals is disposed on the at least one first surface portion of the mounting body.

10. The light source device according to claim 1, wherein the first surface portion and the second surface portion are formed on the same member.

11. The light source device according to claim 1, wherein the mounting body is formed by any one of aluminum, aluminum alloy, copper, copper alloy, stainless steel, steel material, Super Invar, Kovar and aluminum nitride.

12. The light source device according to claim 2, further comprising a heat radiator, wherein the heat conducting member is longer than the mounting body in one direction, a surface of each of the at least one heat conducting member opposite to a surface which is in contact with the second surface portion is in contact with the heat radiator, and the third surface portions of the mounting body is further in contact with the heat radiator.

13. The light source device according to claim 2, wherein the first surface portion, the second surface portion and the third surface portion are formed on the same member.

14. The light source device according to claim 6, wherein the heat conducting member is a highly heat conducting block.

15. The light source device according to claim 7, wherein the heat radiator is a stack-fin radiator.

16. The light source device according to claim 12, wherein the heat radiator is a stack-fin radiator.

17. The light source device according to claim 8, wherein side surfaces and bottom surface of a body of the light source are in contact with the inner surfaces of a light source housing portion via a fixing material.

18. The light source device according to claim 9, further comprising a first wiring board and a second wiring board, wherein the plurality of light sources are arranged in a first row and a second row adjacent to each other and substantially in parallel to each other, the first wiring board electrically connected to the terminals of the light sources in the first row; and the second wiring board electrically connected to the terminals of the light sources in the second row, wherein the at least one heat conducting member is arranged between the first wiring board and the second wiring board.

19. The light source device according to claim 18, wherein the terminals of the light sources are each arranged offset from a center of each of the light sources.

20. The light source device according to claim 14, wherein a heat conductivity of the highly heat conducting block is higher than that of the mounting body.

* * * * *